US006029408A

United States Patent [19]

Cavaness

[11] Patent Number: 6,029,408

[45] Date of Patent: Feb. 29, 2000

[54] PRE-FABRICATED STEP AND STAIRWAY SYSTEM

[75] Inventor: Joseph A. Cavaness, Riverdale, Ga.

[73] Assignee: Cavaness Investment Corporation, Riverdale, Ga.

[21] Appl. No.: 09/243,270

[22] Filed: Feb. 3, 1999

Related U.S. Application Data

[63] Continuation-in-part of application No. 29/098,431, Dec. 29, 1998.

[51] Int. Cl.[7] ..... E04F 11/00

[52] U.S. Cl. ..... 52/188; 52/182; 52/183; 52/191

[58] Field of Search ..... 52/182, 183, 188, 52/191

[56] References Cited

U.S. PATENT DOCUMENTS

| | | | |
|---|---|---|---|
| 3,055,146 | 9/1962 | Lobato | 50/109 |
| 3,814,371 | 6/1974 | Locricchio | 249/14 |
| 4,951,434 | 8/1990 | Schmidt | 52/191 |

*Primary Examiner*—Carl D. Friedman
*Assistant Examiner*—Nkeisha J. Maddox
*Attorney, Agent, or Firm*—Louis T. Isaf; Womble Carlyle Sandridge & Rice

[57] ABSTRACT

The present invention is a prefabricated step and stairway system, where the prefabricated step is preferably a precast concrete step having an elongate body substantially triangular in cross-section having a first side as a tread, a second side as a riser adjacent the first side, and a third side, and the step further has a first and second end which preferably include an attachment member to attach the step between a pair of stringers. The attachment member is preferably integrated metal plates proximate to the first end and second end to facilitate attachment between a pair of stringers, and preferably includes one or more reinforcing members attached to the metal plates and integrated throughout the length of the body to strengthen the step. The prefabricated steps are rigidly secured either to intermediate runners between a pair of stringers, upon a brace, or directly to stringers to form a stairway. There is also provided an inventive mold for forming a precast concrete step preferably at remote locations to the installation site of the stairway.

32 Claims, 5 Drawing Sheets

PRE-FABRICATED STEP AND STAIRWAY SYSTEM

CROSS REFERENCE TO RELATED APPLICATIONS

This application is a continuation-in-part of U.S. application Ser. No. 29/098,431, filed Dec. 29, 1998.

BACKGROUND OF THE INVENTION

1. Field of the Invention

The present invention generally relates to stairway structures. More particularly, the present invention relates to prefabricated concrete steps and stairway systems.

2. Description of the Related Art

It is well known in the art of construction to use concrete in the construction of stairs and stairways. Concrete is often used as a building material because it is durable and satisfactorily withstands public usage. Further, it is known to form a staircase with a plurality of pans rigidly attached between a pair of stringers, and to then pour concrete into the pans to cure therein to form the treads for the individual steps. An example of such pan-stringer construction is U.S. Pat. No. 4,838,005 to Graham et al.

The use of the pan between the stringers has shortcomings in that water can seep between the concrete and the pan and cause rust to the pan, which requires repair. Additionally, the concrete expands and contracts within the pan when subjected to significant temperature gradients, thus causing the pan to warp and the concrete tread to become unstable. Moreover, the concrete must be poured within the pans once the pans are in place on the stringers in order to properly form the staircase, adding to construction costs and time requirements at the job site.

Prefabricated stair systems are also known in the art, examples being U.S. Pat. Nos. 4,995,205 to Bennett; U.S. Pat. No. 5,203,128 to Bennett; and U.S. Pat. No. 3,981,112 to Dake. These patents illustrate various prefabricated and precast stairs and stair systems for installation into dwellings whereby stringers are put between various levels which are desired to be traversed by the staircase, and then precast steps are installed within the stringer to form the staircase. Various methods are used to attach the individual steps to the stringers to form the staircase, such as bolting the individual stairs to the stringers as in the Bennett '128 and Dake patents, or resting the precast stairs upon the stringers prior to fastening the stairs to the stringers, as shown in the Bennett '205 patent.

There are problems and shortcomings in the prior art of precast steps and stair systems, which neither the above nor any other reference known to the inventor fully addresses. It is accordingly to the provision of a precast concrete step and stairway system that addresses and solves the problems and shortcomings of the prior art that the present invention is primarily directed.

SUMMARY OF THE INVENTION

Briefly described, the present invention includes in its most preferred embodiment, a pre-fabricated step and stairway system. The prefabricated step is preferably a precast concrete step that includes an elongated precast body substantially triangular in cross-section and having a first side, a second side, and a third side, wherein the first side comprises the tread and the second side comprises a riser, and the first and second side form an edge therebetween. The step further includes one or more attachment members embedded within the body and being accessible from the step environs by which the step is attachable to a support structure. The attachment member is, preferably, accessible from the third side of the step body. Most preferably, the attachment member defines a planar attachment surface that is exposed to the environment along the third side of the step body, and which planar attachment surface is generally parallel to (and, preferably, co-planar with) the third side.

In a first preferred embodiment, the body has a first end and a second end, and an attachment member (preferably a metal plate) is integrated at each of the first and second end of the body to rigidly attach the step between a pair of stringers. The precast concrete step embodiments further preferably includes a reinforcing member integrated along the length of the body and, preferably, attached to the pair of attachment members at the first and second end of the body. The precast concrete step is alternately embodied with more than one reinforcing members attached between the respective attachment members and integrated along the length of the body.

The second side of the precast concrete step which comprises the riser preferably defines an inward taper such that a toe space is created when a plurality of steps are aligned to form a stairway. In the preferred embodiment, the second side further defines an edge portion generally perpendicular to the first side (tread) and a taper portion extending therefrom to the third side.

The present invention also includes a stairway comprised of a pair of support members, referred to generically in this disclosure in their various structural forms as "stringers", and a plurality of precast concrete steps rigidly attached between the pair of stringers. Each of the precast concrete steps preferably includes an elongate precast body substantially triangular in cross-section having a first side, a second side, and a third side, wherein the first side comprises a tread and the second side comprises a riser with an edge therebetween, and the body further has a first end and a second end, with attachment members integrated with the body at the first and second ends, whereby the attachment members are used to rigidly attach the step between the stringers. The stairway alternately includes a brace underneath the plurality of concrete steps where each of the plurality of steps is rigidly attached to the brace. The use of such brace can alternatively be without a plurality of stringers so as to form a "monumental stairway".

Preferably, the stairway includes a pair of intermediate support members rigidly affixed to the stringer and to the attachment members, such that the intermediate support members are used to attach each precast concrete step from its first and second ends, between the pair of stringers. In the preferred embodiments, the intermediate support members include a pair of elongated runners, each runner rigidly attached to a stringer, and to which rigidly attach the attachment members respectively on the first and second end of each step. Most preferably, the elongated runners extend the useful length of the stringers and define a planar attachment surface which defines an angle of ascent relative to the horizontal which is approximately equal to the rise angle defined between the tread side and the third side of the step body. The pair of runners support a plurality of pre-formed steps thereon. Alternately, a plurality of individual metal members functioning as intermediate support members are attached to the individual precast concrete steps or to the stringers prior to the attachment of the precast concrete steps between the stringers, thereby avoiding the use of runners. Still other, alternate, intermediate support members are acceptably within the scope of the invention.

The method of making the preferred embodiment of the stairway of the present invention includes prefabricating or casting one or more steps preferably by pouring concrete mixture within a preshaped mold to cure within the mold, thereby creating steps having an elongate body substantially triangular in cross-section, defining a tread side, a riser side, and a third side, and having a first and second end, removing each cured concrete step from the respective molds, securing a pair of stringers where a stairway is desired, and then sequentially securing a plurality of cured concrete steps between the secured pair of stringers to thereby create a stairway. The method alternately includes the step of placing attachment members (preferably, metal plates) within the mold prior to pouring the concrete mixture such that each attachment member is respectively integrated proximate to the first and second end of each cured concrete step, with a portion of its surface (e.g. a metal plate surface) exposed to the environment along the third side. The method further alternatively includes placing a reinforcing member integrated with the attachment member within the mold prior to pouring the concrete mixture whereby the reinforcing member is integrated along the length of the body of the cured concrete step and with the attachment member on the first and second end.

The preferred method of making the stairway includes preferably connecting the attachment members to the stringers to thereby secure each step between the stringers to form a stairway. Most preferably, such method further includes attaching or otherwise defining a runner along each of the stringers, whereby each attachment member on the first and second end of each concrete step is connected to a runner. In preferred embodiments, the stringers, runners, and attachment members are all made of metal and the method includes welding the runners to the stringers and, then, welding the metal plate attachment members on the first and second end of the precast concrete step to each of the runners. Other methods such as bolting an individual runner to the stringer or actually bolting the precast concrete step to the stringer are alternately used.

The present invention additionally includes a preferred method of forming a concrete step in a mold designed to form a step having an elongate body substantially triangular in cross-section and having a first end and second end, the method including the steps of pouring concrete mixture into the mold, and removing the cured concrete step from the mold. The method of making the precast concrete step further preferably includes the step of placing a pair of attachment members (for example, metal plates) in the mold such that each of the attachment members is integrated into the cured concrete step proximate to the first and second end of the step respectively. Further, the method of making the precast concrete step alternately includes the step of placing one or more reinforcing members into the mold and integrated with the metal plates whereby the reinforcing member is integrated throughout the length of the elongate body of the cured concrete step.

Therefore, it is an object of the present invention to provide a precast concrete step and stairway system which simplifies the construction of a stairway through the use of prefabricated materials. The present invention includes a precast concrete step which is ready for rigid attachment between a pair of stringers at the installation site without the additional pouring of concrete necessary. Furthermore, the present invention provides an economical method to fabricate concrete steps for use in stairway systems.

Whereas, the present invention preferably comprises a precast concrete step with metal attachment members and stairway systems and method incorporating such precast concrete step, certain aspects of the present invention are believed to advance the art of pre-fabricated steps made of other building materials. Thus, in alternate embodiments, the body is constructed from materials other than concrete, such as wood, plastic, or other rigid material. Further, the body of the step, in alternate embodiments, while still conforming to other aspects of the preferred embodiments, is hollow or semi-hollow for conservation of weight, provided that the loss of material does not significantly affect rigidity.

Other objects, features, and advantages of the present invention will become apparent after review of the hereinafter set forth Brief Description of the Drawings, Detailed Description of the Preferred Embodiments, and Claims appended herewith.

DETAILED DESCRIPTION OF THE PREFERRED EMBODIMENTS

Figure 1:
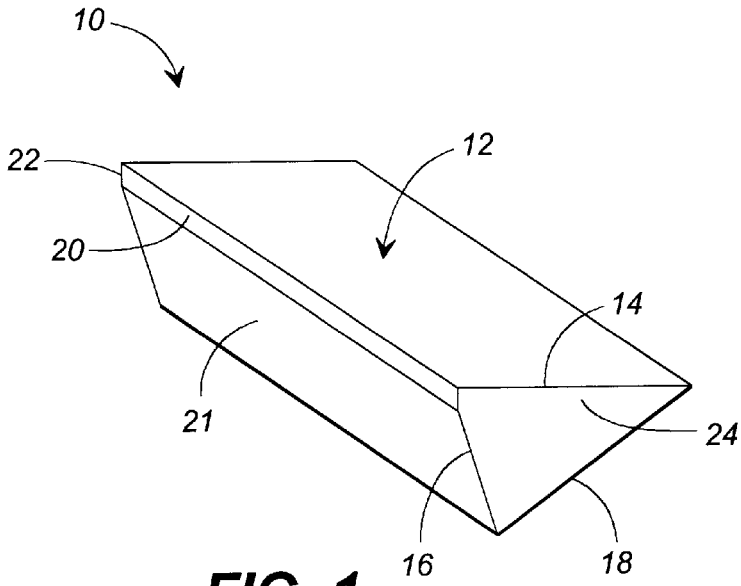
FIG. 1 is a perspective view of the preferred embodiment of the precast concrete step.

Referring now in greater detail to the drawings, in which like numerals represent like components throughout the several views, FIG. 1 illustrates the preferred embodiment of a precast concrete step 10 in its most preferred form. The precast concrete step 10 has an elongated body 12 substantially triangular in cross-section, with a first side 14, a second side 16, and a third side 18, where the first side 14 forms a tread and the second side 16 forms a riser, wherein a plurality of the concrete steps 10 are aligned to form a staircase. The second side 16, preferably, includes an edge portion 20 and a taper portion 21. The edge portion 20 is preferably, perpendicular to the first side 14, extending from the edge between the first side 14 and the second side 16 to a predetermined width, for example, without limitation, 1 inch. The edge portion 20 minimizes chipping on such edge from walking thereupon, as well as reducing the chance of tripping on the edge of the step. The body 12 further includes a first end 22 and a second end 24 which preferably, although not necessarily, abut a pair of stringers.

Figure 2:
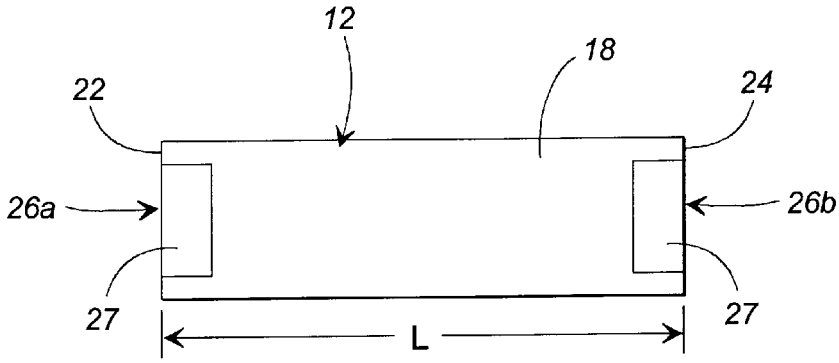
FIG. 2 is a bottom view of the third side of the preferred embodiment of the precast concrete step of FIG. 1.
Figure 3:
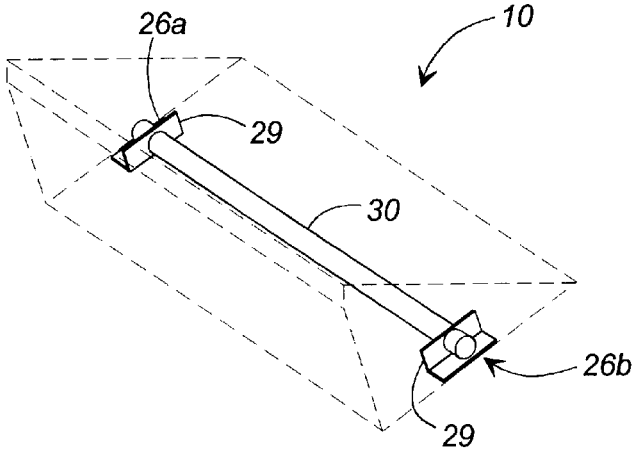
FIG. 3 is a perspective view of a reinforcing member integrated throughout the length of the body of the preferred embodiment of the precast concrete step.
Figure 4:
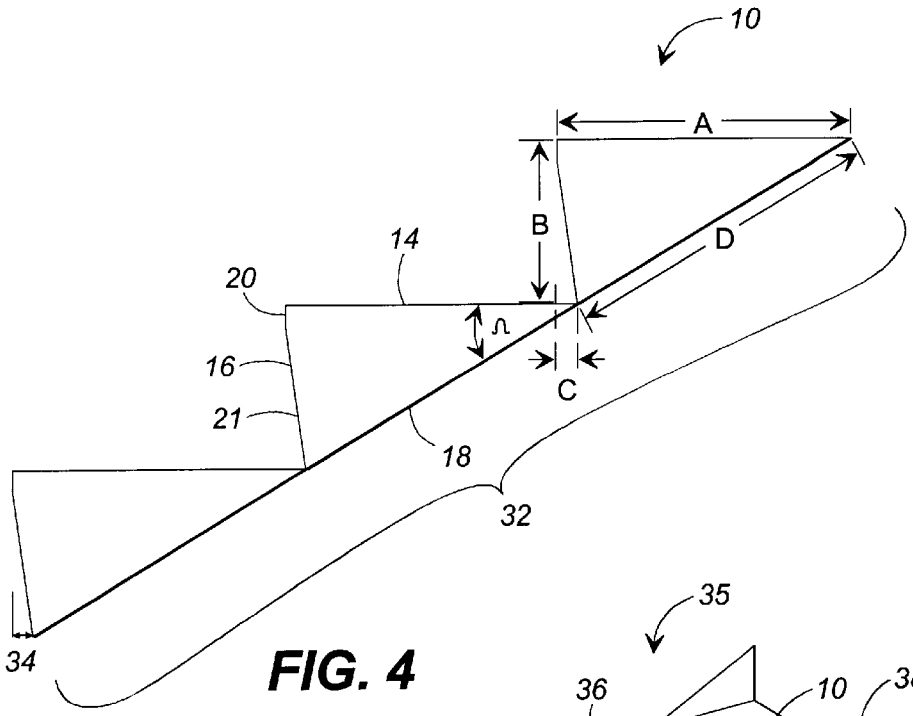
FIG. 4 is a schematically represented side view of a plurality of precast concrete steps arranged to form a stairway.

FIG. 2 more particularly illustrates the third side 18 of the body 12 which will face down from the stairway when installed therein (see FIG. 4). In preferred embodiments, the third side 18 functions as the mounting side, by which the step 10 is supported and mounted to a support structure of a stairway. The third side preferably includes a pair of attachment members 26*a* and 26*b*, respectively integrated with the first end 22 and second end 24 of the elongate body 12. with reference to FIG. 2 and FIG. 3, (and with additional reference to FIG. 10, discussed in more detail below,) the preferred embodiments of the attachment members 26*a*, 26*b* include a planar attachment surface 27 which is exposed to the environment through the third side 18 of the step body 12. In the preferred embodiments, the planar attachment surface 27 of each attachment member 26*a*, 26*b* is oriented such that the plane of the mounting surface is parallel to (and, most preferably, co-planar with) the surface of the third, mounting side 18 of the step body 12. In the preferred embodiments, the planar attachment surfaces 27 of the attachment members 26*a*, 26*b* extend to the edges of the first end 22 and second end 24 of the body 12, respectively. Each attachment member 26*a*, 26*b* also includes an anchor tab 28 which projects inward, into the body of the step and which is embedded within the composite material (preferably concrete) of the step body 12. As further described herein, the attachment members assist in the preferred method of attaching the precast concrete step 10 between a pair of stringers. In the most preferred embodiments, the attachment members 26*a*, 26*b* are formed entirely of metal.

In the depicted embodiments, each attachment member 26*a*, 26*b* further includes an aperture 29 formed in the anchor tab 28. A reinforcing member 30, such as a "rebar", is integrated throughout the length of the precast step 10 and, in the preferred embodiments, the reinforcing member 30 extends through the aperture 29 of each attachment member 26*a*, 26*b* such that, when embedded within the concrete of the body 12, the reinforcing member 30 and the attachment members 26*a*, 26*b* form an integrated connection. In alternate, preferred embodiments, the reinforcing member is rigidly attached, as by welding, to each of the attachment members 26*a*, 26*b*. The integrated connection of the reinforcing member 30 and the attachment members 26*a*, 26*b* is intended to strengthen the precast concrete step 10, thereby increasing the load capacity of the stairway, and, furthermore, is intended to prevent separation of the step body 12 from the attachment member plates 26*a* and 26*b*. More than one reinforcing member 30, as well as other wires and frames are, alternatively, integrated into the precast concrete step 10 to strengthen the step.

Referring now to FIG. 4, a plurality of precast concrete steps 10 is shown in alignment to schematically represent the formation of a stairway 35. It can best be seen that each precast concrete step 10 is aligned such that the first side 14 forms the (preferably horizontal) tread, the second side 16 forms the riser, and the third side 18 aligns with other precast concrete steps to form a generally planar underside of the stairway 35. Identified in this view is the angle "Ω" between the first side (tread) 14 and third side (mounting side) 18, which angle represents the slope or "rise ratio". Further, the inward taper of the second side 16 creates a toe space 34.

Figure 5A:
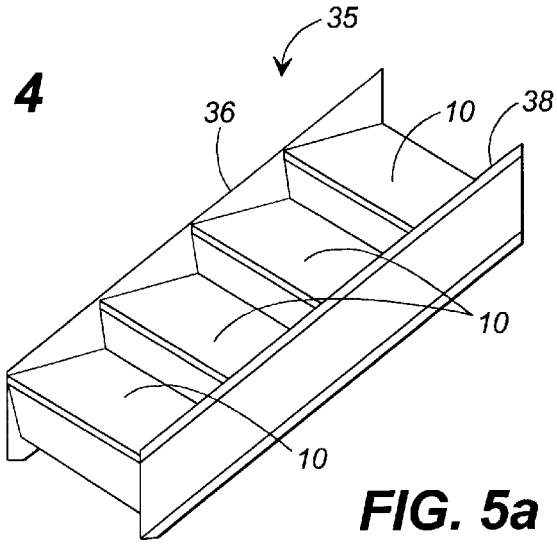
FIG. 5A is a perspective view of the preferred embodiment of a stairway comprised of a preferred precast concrete steps.
Figure 5B:
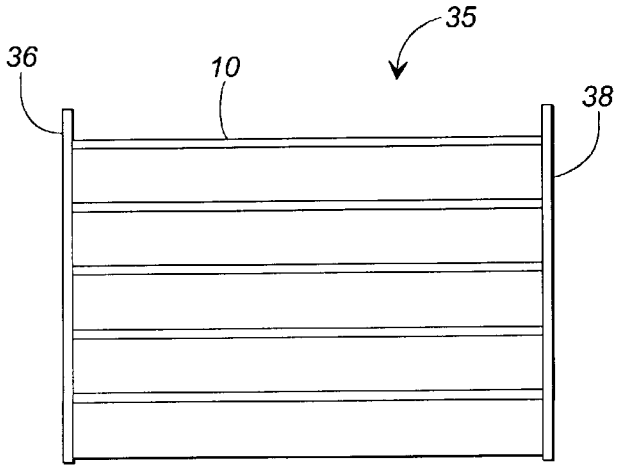
FIG. 5B is a front view of the stairway of FIG. 5A.

FIGS. 5A and 5B illustrate a preferred stairway using a plurality of precast concrete steps 10 between a pair of stringers 36 and 38. The stairway 35, shown in perspective view in FIG. 5A and front view in FIG. 5B, illustrates each of the precast concrete steps 10 rigidly secured between a pair of stringers 36 and 38 and ready for public usage.

Figure 6:
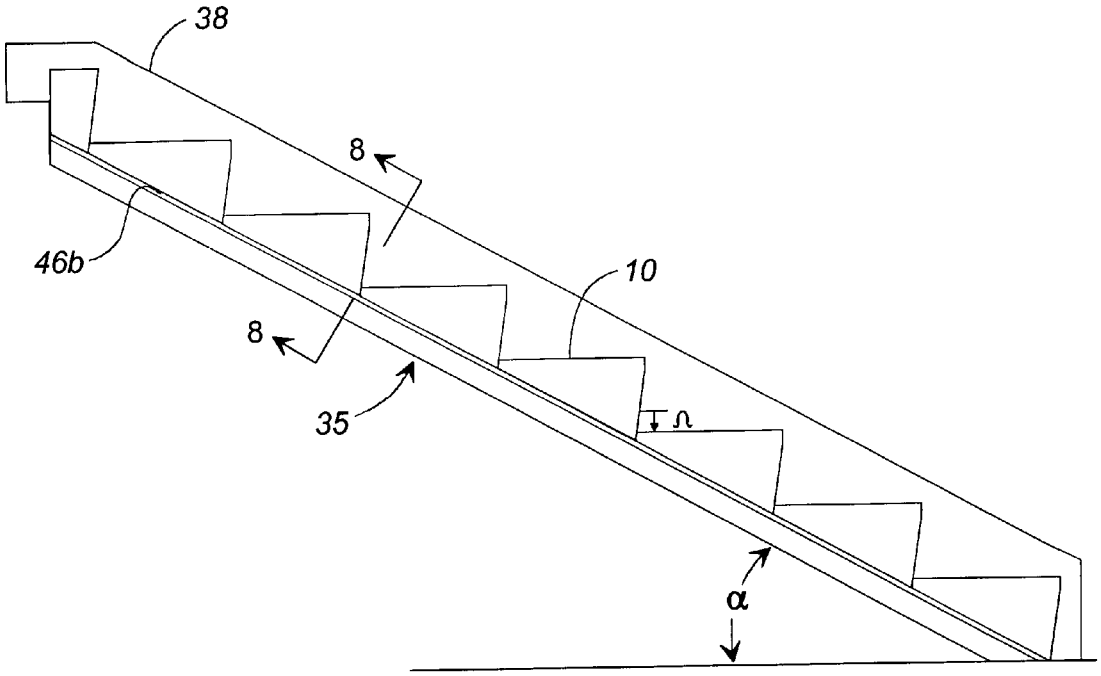
FIG. 6 is a side view of the preferred embodiment of a stairway including a plurality of the preferred precast concrete steps, with the near side stringer removed.

FIG. 6 shows a plurality of precast concrete steps 10 from the side, the steps rigidly attached to a runner 46*b* attached to a stringer 38 (the other runner and stringer are not shown, for clarity) that is adapted to ascend levels at a predefined angle of ascent ("α") from floor to landing. It can be seen that the stairway formed from the precast concrete steps 10 should be formed to accommodate the particular angle of the stairway to insure that the tread will be substantially level. Thus, preferably, the angle of ascent (α) of the stairway 35 is approximately equal to the rise ratio (Ω) of the steps 10. FIG. 6 also illustrates the smooth, planar underside of the plurality of concrete steps 10 forms when aligned on the runners 42 in a stairway.

Figure 7:
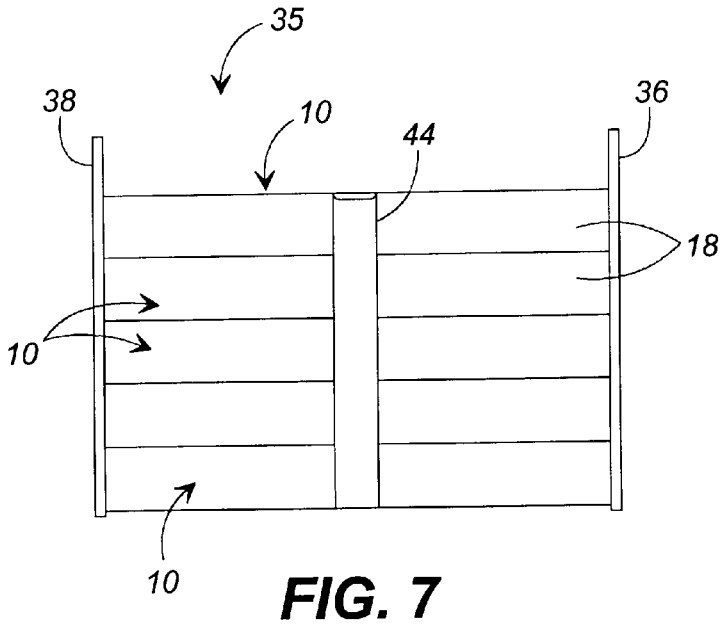
FIG. 7 is a rear view of the preferred stairway including the precast concrete steps and a brace thereunder.

FIG. 7 illustrates a rear view of the stairway 35 with a plurality of concrete steps 10 rigidly secured between the pair of stringers 36 and 38, and further illustrates the use of a brace 44 underneath the planar third side 18 of the steps 10. The brace 44 is preferably used to strengthen the staircase 35, but is not necessary when the steps 10 are secured between the pair of stringers 36 and 38. Furthermore, if a monumental stairway (not shown) is desired, only brace 44 need be used (together with alternate, central positioning of the attachment member 26 in the third side 18) to support the plurality of precast concrete steps 10 to form a stairway without the need of the pair of stringers 36 and 38. The size of the brace 44 will therefore vary depending on the load bearing capability desired, as well as the size of the monumental stairway. Additionally, one or more additional attachment members 26 can be placed in the center of the precast concrete step 10 to better attach to a brace 44, which is recommended if the braces are the sole support for the steps. Although, other methods of attachment of the precast concrete step 10 to the brace 44 as would be understood by those skilled in the art can be alternately used.

Figure 8A:
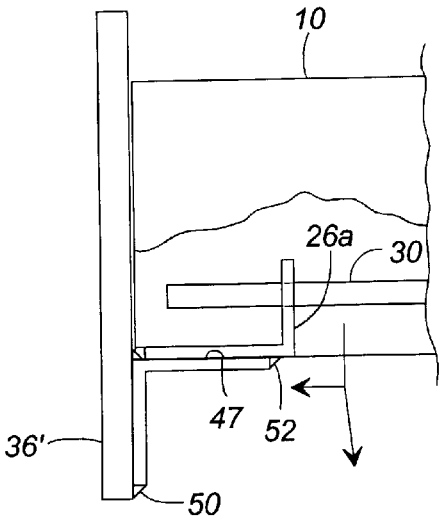
FIG. 8A is an isolated, cutaway view of the stairway of the present invention, showing a preferred attachment of a precast concrete step to a runner on a plate stringer.

FIGS. 8A–8D each illustrate alternate embodiments of combinations of the precast concrete step 10 with stringers or to other structures. FIG. 8A is a cutaway view illustrating precast concrete step 10 resting upon a metal runner 46*a*, which is an elongate angle iron (including a planar supporting surface 47) rigidly secured to a metal plate stringer 36'. A metal plate attachment member 26*a* in the precast concrete step 10 is also attached to reinforcing member 30 to strengthen the step. The runner 46*a* (shown in the preferred form of an elongated angle iron) is welded (as represented by points 50 and 52) to the plate stringer 36' and metal plate 26*a* of the precast concrete step 10, respectively.

Figure 8B:
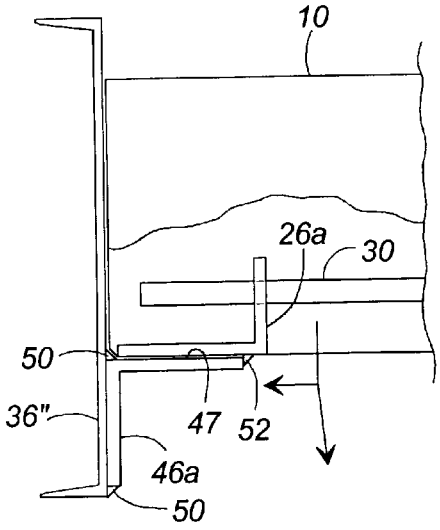
FIG. 8B is an isolated view of the stairway of the present invention, showing an attachment of a precast concrete step to a runner on channel stringer.

FIG. 8B illustrates the attachment of a precast concrete step 10 to a channel stringer 36" in like manner to the attachment of the precast concrete step 10 to the plate stringer 36' in FIG. 8A. FIG. 8B likewise illustrates the use of runner 46*a* and welds 50 and 52 to secure the precast concrete step 10 to the channel stringer 36".

Figure 8C:
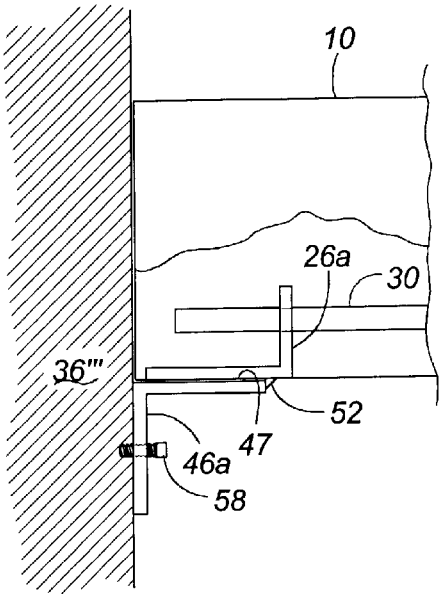
FIG. 8C is an isolated, cutaway view of the stairway of the present invention, showing an attachment of a precast concrete step to a wall through the use of a metal member and a bolt.

FIG. 8C shows a precast concrete step 10 rigidly secured to a wall 36''' functioning as stringer. The precast concrete step 10 rests upon runner 46*a* with weld 52 holding the metal plate 26*a* thereto, in like manner to the methods of attachment shown in FIGS. 8A and 8B. However, a bolt 58 is used to secure runner 46*a* to the wall/stringer 36''' thereby supporting the precast concrete step 10.

Figure 8D:
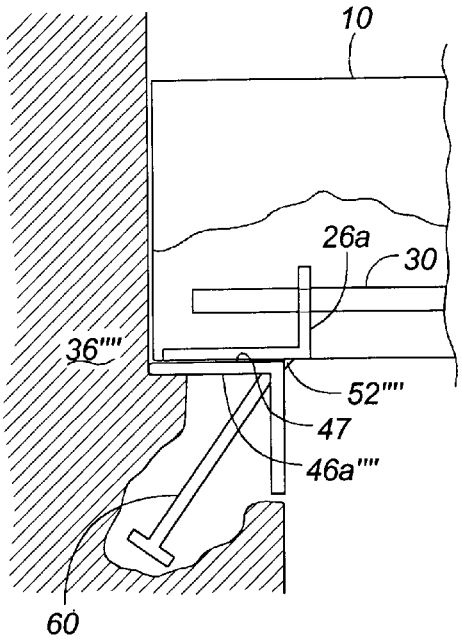
FIG. 8D is an isolated, cutaway view of a stairway of the present invention, showing an attachment of a precast concrete step to an anchor which forms a runner in a ledge.

FIG. 8D illustrates a precast concrete step 10 with a wall 36'''', functioning as the stringer, which supports a runner 46*a*'''' within, and in the form of, a ledge. An anchor 60 is shown reinforcing the runner 46*a*''''. The precast concrete step 10 rests on the runner supporting surface 47 and is secured by a weld 52'''' to the runner 46*a*''''.

It should be understood that other methods of attachment of the runner 46 to the precast concrete step 10, or the wall/stringer 36, are alternatively used in the various embodiments of the present invention, to include, but not be limited to, bolts, welds, nails, adhesives, and other methods as known in the art It is also foreseeable that the precast concrete step 10 can be cast with a specific shape, or have integrated therein a structure to interlock with a runner, stringer or other form to create an adequately secure stairway which will perform in the manner as herein described.

Figure 9:
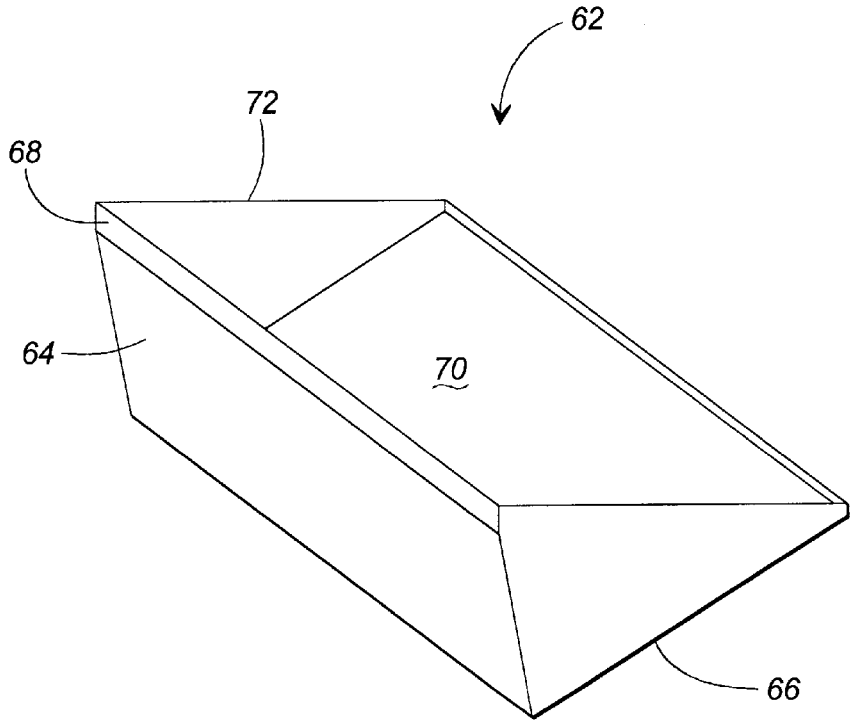
FIG. 9 is a perspective view of the preferred embodiment of the mold for making the preferred embodiment of the precast concrete step.

FIG. 9 shows the preferred form of a mold 62 for creating the precast concrete step 10 through the pouring and curing of concrete. The mold 62 is comprised of the front side 64 which forms the second side 16 of the concrete step 10, preferably having a one inch planar edge 68 of the mold 62 which makes the planar portion 20 of the second side 16 of the precast concrete step 10, and the mold 62 further includes rear portion 66 which makes the third side 18 of the precast concrete step 10. Concrete is poured in its aqueous form into the interior cavity 70 of the mold 62 until the aqueous concrete comes to rest at the top edge 72 of the mold 62 which will form the first side 14 of the precast concrete step 10 once the concrete cures.

Figure 10:
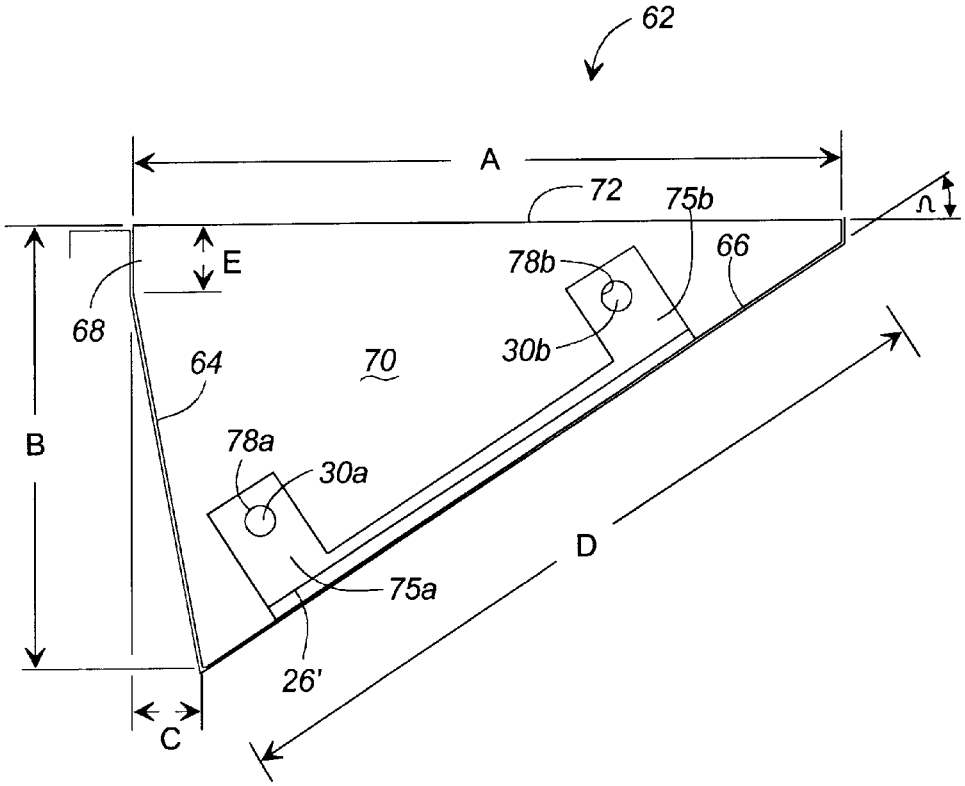
FIG. 10 is a cross-sectional side view of the preferred mold for making a precast concrete step of FIG. 9, illustrating the placement of a metal plate and reinforcing members within the mold.

FIG. 10 particularly illustrates the mold 62 from the side (in cross-section), with an insertion of an alternate embodiment of the attachment member 26' therein. The alternate attachment member 26' of the depicted embodiment of FIG. 10 is a metal plate formed with two upwardly extending anchor tabs 75*a*, 75*b* each defining an aperture 78*a*, 78*b* therethrough. A reinforcing member 30*a* and 30*b* extends through each aperture 78*a*, 78*b* and extend throughout the length of the mold to thus be incorporated into the elongate body 12 of the precast concrete step 10, once the concrete is poured into and cured within the mold 62. It is further seen that the preferred dimensions of the mold mirror that of the preferred dimensions of the precast concrete step 10.

By way of example, the preferred dimensions of the step 10 for general public usage are: tread depth (distance A) being in the range of about 10 to 12 inches, most preferably about 11 inches; the riser height (distance B) being in the range of about 6 to 8 inches, most preferably, about 7 inches, with an inward taper to about 1 inch off plumb (distance C); and the length of the third side (distance D) being calculatable, and most preferably, about 13 inches; and the rise ratio (Ω) also being calculatable, and thus, falling generally in the range of 30° to 37°, with about 32° being most preferred. The length (Dimension "L"—see FIG. 2) of the step, i.e. from the first end 22 to the second end 24, varies according to the width of the stairway. Providing for slight thickness of the mold 62, such dimensions should provide a precast concrete step 10 of adequate dimensions for use in most construction purposes as herein described. Moreover, the preferred dimensions are for the purpose of complying with most building codes for public stairways, and are thus merely illustrative and do not limit the dimensions of the precast concrete step 10. Additionally, while the preferred prefabricated step is solid, it is foreseeable that the step can be alternately constructed as hollow or semi-hollow, so long as the substantially triangular cross section is maintained sufficiently to perform the functions disclosed herein. Such construction must also provide adequate rigidity to perform as a stair receiving public traverse.

The mold 62 is preferably made from any inexpensive rigid or semi-rigid material, to include metals or plastics, whereby the production and use of many molds provides that many precast concrete steps 10 can be made simultaneously for simple installation at a remote location to form a stairway. In making the precast concrete steps remotely from the stairway installation site, construction labor is conserved as concrete pouring and curing at the installation site is not necessary for the installation of the steps.

Any standard mixture of concrete may be used to form the present inventive precast concrete step 10, provided that the cured concrete conforms to the rigidity, durability and fire-retardative requirements of particular building codes, as well as requirements dictated by design parameters of various stairways. It is foreseeable, however, that substances other than concrete can be used to create the prefabricated step, such as wood, plastics, metals, or other curable materials.

The present invention accordingly provides a method of making a stairway with the precast concrete steps, such as those shown in FIGS. 5A through 7, which includes the steps of casting one or more precast concrete steps 10 by pouring the concrete mixture into one or more molds 62 to thereby cure within each mold 62, and then removing each cured precast concrete step 10 from the respective molds, securing a pair of stringers 36 and 38 to a structure where a stairway is desired (such as shown in FIGS. 5A and 5B), and then sequentially securing a plurality of the cured precast concrete steps 10 between the secured pair of stringers 36 and 38 to thereby create the stairway. Alternately, the preferred method further includes the step of placing one or more attachment members 26, such as metal plates 26*a*, 26*b*, within the mold 62 prior to pouring the concrete mixture therein, so that that each attachment member 26*a*, 26*b* is respectively integrated into the elongate body 12 of the precast concrete step 10 proximate to the first end 22 and second end 28 of the body 12, respectively, and exposed from the third side 18. Additionally, the method preferably includes integrating a reinforcing member or members, such as reinforcing member 30, with the attachment members 26*a*, 26*b* prior to the concrete being poured within the mold 62 such that the reinforcing member 30 is integrated throughout the length of the body 12 of the precast concrete step 10. The present method also preferably includes the step of securely attaching intermediate support members 46, such as runners 46*a*, 46*b*, to the stringers 36, 38 and attaching the steps to such intermediate support members.

An example of the most preferred embodiment of the method of making a stairway 35 in accordance with the present invention includes the following steps:

A plurality of pre-fabricated steps 10, preferably made of concrete with metal rebars 30*a*, 30*b* and metal attachment members 26*a*, 26*b* (of the form seen in FIG. 10) are cast independently (each step separately cast) in a mold similar to that discussed in connection with FIG. 10. Each step is cast in the generally triangular, elongated shape and design as described herein in connection with FIGS. 1–3.

The precast steps 10 are precast with particular dimensions which, in the view of the manufacturer, will be universally acceptable with respect to the tread depth (distance A of the FIG. 10), and riser height (distance B) and, thus, defining a particular slope or rise angle "Ω".

The plurality of precast steps 10 are delivered to a building site as building material along with metal materials which would function as stringers 36, 38 (as would be understood by those skilled in the art) and elongated, metal angle irons to be used as runners 46 (46*a*, 46*b*).

When it becomes necessary to install a stairway, stringers 36,38 are raised and supported in a manner which would be understood by those skilled in the art. The stringers are supported generally so as to be able to support thereon elongated runners 46 which will define a rate of ascent (α) which is approximately equal to the rise ratio Ω of the steps.

With the stringers 36, 38 supported, the angle irons 46*a*, 46*b* are welded to the respective stingers in such a manner that the planar mounting surface 47 of each runner 46*a*, 46*b* ascends, relative to the horizontal, at an angle of ascent (α) which is approximately equal to the precast rise angle (Ω) of the steps 10. The planar supporting surface 47 of each runner 46*a*, 46*b* extends from the stringer inwardly toward the opposite stringer. It will be understood that the stringers 36, 38 are spaced apart at a distance approximately equal to the length "L" of the pre-fabricated steps 10. Alternately, the runners 46*a*, 46*b* are acceptably mounted to the stringers 36, 38 prior to the raising and installing of the stringers.

With the stringers and runners raised and supported, the pre-fabricated steps 10 are placed within the stringers one at a time and attached to the runners 46*a*, 46*b*. Since the angle of ascent (α) of the stringer/runner mounting surface 47 is equal to the rise angle (Ω) of the step mounting side 18 (and, thus, the co-planar attachment surface 27 of the attachment members 26*a*, 26*b*) it can be seen that the pre-fabricated steps 10 are quickly and easily installed by simply laying the third, mounting side 18 of each step flat against the supporting surface 47 of the runners 46*a*, 46*b* and then welding the adjacent surfaces of the runners 46*a*, 46*b* and attachment members 26*a*, 26*b*. Where an intermediate brace 44 is included in the stairway, such as shown in FIG. 7, the method of attachment of the plurality of precast concrete steps 10 alternately, though not necessarily, includes securing each precast concrete step 10 to the brace 44 through one of the methods as described herein.

In accordance with an exemplary embodiment of assembling "monumental stairs", a single brace member 44 is raised and supported to define a planar supporting surface along the top side of the brace, which planar surface is oriented at an angle of ascent approximately equal to the rise angle of the pre-fabricated steps 10. The pre-fabricated steps 10 used in this exemplary embodiment will include a single attachment member 26 embedded in the step of body 12 so as to display a planar attachment surface 27 exposed generally centrally located in the third side 18 of the step. Each such pre-fabricated step is placed sequentially on the brace 44 and welded or otherwise attached to the brace at the attachment member.

Whereas in the preferred embodiment, all of the stringers 36, 38, intermediate support members 46 (such as runners), and attachment members 26 are formed entirely of metal and are welded together, less preferred embodiments utilize components made of other materials. By way of example only, alternate embodiments will include attachment members 26 made of wood and wooden runners 46 and wooden stringers 36, 38, all of which are attached one to another by nails or screws. Another example of an alternate embodiment includes plastic attachment members 26 which include pre-drilled screw or bolt holes formed in the planar attachment surface 27, and the stringers and runners are made of wood, plastic, or metal and the components are attached one to another by bolts or screws. Other alternate combinations as will be apparent to those skilled in the art after review of the above.

While there has been shown the preferred and alternate embodiments of the present invention, it is to be understood that the invention may be embodied than is otherwise herein specifically shown and described, and that within the embodiments, certain changes may be made in the form and arrangement of the parts without departing from the underlying ideas or principles of the invention as set forth in the Claims appended herewith. In addition, all means or step-plus-function elements in the Claims are intended to encompass all methods, devices, acts, and capabilities of one of the skill in the art in practicing the present invention, and are not to be limited to the preferred embodiments that are set forth herein for purposes of illustration and not limitation.

What is claimed is:

1. A prefabricated step including a tread and a riser, comprising:

an elongated body substantially triangular in cross-section and having at least a first side, and a second side, wherein said first side comprises the tread and said second side comprises a riser and form an edge therebetween, said body further having a first end and second end;

at least one attachment member integrated with said body, wherein said at least one attachment member includes a pair of plates, one of said plates rigidly integrated with said body proximate to said first end and the other of said plates rigidly integrated with said body proximate to said second end;

a reinforcing member integrated along the length of said body, and wherein said plates are rigidly attached to said reinforcing member, and a pair of metal members, each said member rigidly attached to said plates respectively on said first end and said second end of said body.

2. The prefabricated step of claim 1, wherein said at least one attachment member includes a separate attachment member proximate to each said first end and said second end of said body.

3. The prefabricated step of claim 1, wherein the second side comprising the riser includes an inward taper whereby a toe space is created when a plurality of said steps are aligned to form a stairway.

4. The prefabricated step of claim 3, wherein said second side includes a planar portion extending from said edge between said second side and said first side to a predetermined height, whereafter said second side includes an inward taper.

5. The prefabricated step of claim 1, wherein said first side is in the range of 10 to 12 inches in depth, said second side is in the range of 6 to 8 inches in height, and said third side is in the range of 12 to 14 inches in length.

6. The prefabricated step of claim 1, wherein said at least one attachment member is located on said body intermediate to said first end and said second end.

7. The prefabricated step of claim 1, wherein said step is concrete.

8. The prefabricated step of claim 1, wherein said step is wood.

9. The prefabricated step of claim 1, wherein said step is plastic.

10. A stairway, comprising:

a pair of spaced apart stringers;

a plurality of prefabricated steps rigidly attached to said at least one support member, each of said prefabricated concrete steps comprised of:

an elongated body substantially triangular in cross-section and having at least a first side and a second side, wherein said first side comprises the tread and said second side comprises a riser and form an edge therebetween, said body further having a first end and second end; and at least one attachment member including a pair of plates rigidly integrated with said body side, one said plate being proximate to said first end and the other said plate being proximate to said second end; and a plurality of intermediate support members, each said intermediate support member being rigidly attached to one of said stringers, and each said intermediate support member being in contact with one plate of said pair of plates.

11. The stairway of claim 10, wherein each said precast concrete step includes a reinforcing member integrated along the length of said body, and wherein said plates of said pair of plates are rigidly attached to said reinforcing member.

12. The stairway of claim 10, wherein said second side of said precast concrete step includes an inward taper whereby a toe space is created when a plurality of said steps are aligned to form a stair case.

13. The stairway of claim 12, wherein said second side of said precast concrete step includes a planar portion extending from said edge between said second side and said first side to a predetermined width, whereafter said second side includes an inward taper.

14. The stairway of claim 10, wherein said first side is in the range of 10 to 12 inches in depth, said second side is in the range of 6 to 8 inches in height, and said third side is in the range of 12 to 14 inches in length.

15. The stairway of claim 10, wherein each said intermediate support member defines an elongated planar support surface rigidly attached to one of said stringers and to one of said plates in said body of said step.

16. The stairway of claim 15, wherein said planar support surfaces is supported at an angle of ascent relative to the horizontal which is approximately equal to the rise angle defined between said first side and said third side of said body.

17. The stairway of claim 10, wherein said at least one support member includes a brace underneath said plurality of prefabricated steps.

18. The stairway of claim 17, wherein each of said plurality of steps is rigidly attached to said brace.

19. The stairway of claim 10, wherein each said prefabricated step is concrete.

20. The stairway of claim 10, wherein each said prefabricated step is wood.

21. The stairway of claim 10, wherein each said prefabricated step is plastic.

22. A stairway, comprising:

a pair of spaced apart stringers;

a plurality of prefabricated steps rigidly attached to said at least one support member, each of said prefabricated concrete steps comprised of:

an elongated body substantially triangular in cross-section and having at least a first side and a second side wherein said first side comprises the tread and said second side comprises a riser and form an edge therebetween, said body further having a first end and second end; and at least one attachment member including a pair of plates rigidly integrated with said body, one said plate being proximate to said first end and the other said plate being proximate to said second end; and a plurality metal members rigidly attached to said stringers, whereby each of said steps is rigidly attached to the metal members to thereby secure each of said plurality of steps between the stringers.

23. A method of making a stairway, comprising the steps of:

casting one or more steps by pouring concrete mixture within a preshaped mold to thereby cure within the mold, thereby creating steps having an elongate body substantially triangular in cross-section, and having a first and second end;

removing each cured concrete step from the respective molds;

securing a pair of stringers to a structure where a stairway is desired;

sequentially securing a plurality of cured concrete steps between the secured pair of stringers, thereby creating a stairway;

placing metal plates within the mold prior to pouring the concrete mixture whereby each plate is respectively integrated proximate to the first end and second end respectively of each cured concrete step; and securely attaching at least one runner to each stringer.

24. The method of claim 23, wherein the step of securely attaching at least one runner includes the step of welding at least one runner to each stringer.

25. The method of claim 24, further including the step of securely attaching each of the steps to the runners on the stringers, thereby securing each step between the pair of stringers.

26. The method of claim 25, wherein the step of securely attaching each of the steps to the runners on the stringers includes the step of welding each metal plate on the first and second end of the body respectively to one of the runners.

27. A method of making a stairway, comprising the steps of:

casting one or more steps by pouring concrete mixture within a preshaped mold to thereby cure within the mold, thereby creating steps having an elongate body substantially triangular in cross-section, and having a first and second end;

removing each cured concrete step from the respective molds;

securing a pair of stringers to a structure where a stairway is desired;

sequentially securing a plurality of cured concrete steps between the secured pair of stringers, thereby creating a stairway;

placing metal plates within the mold prior to pouring the concrete mixture whereby each plate is respectively integrated proximate to the first end and second end respectively of each cured concrete step; and securely attaching a plurality of metal members to each of the pair of stringers.

28. The method of claim 27, wherein the step of securely attaching a plurality of metal members includes the step of welding each metal member to one of the stringers.

29. The method of claim 23, further including the step of placing each of a plurality of concrete steps on a brace between the pair of stringers prior to securing each of the plurality of steps between the pair of stringers.

30. The method of claim 23, further including the step of placing a reinforcing member in the mold prior to pouring the concrete mixture into the mold.

31. The method of claim 30, further including the step of attaching the reinforcing member to each metal plate prior to pouring the concrete mixture into the mold.

32. The method of claim 31, further including the step of attaching the reinforcing member to each metal plate whereby the reinforcing member is integrated throughout the length of the elongated body of the cured concrete step.

* * * * *